United States Patent [19]

Akiyama et al.

[11] Patent Number: 4,719,025

[45] Date of Patent: Jan. 12, 1988

[54] SYNTHETIC LUBRICATION OIL COMPOSITIONS

[75] Inventors: Kenyu Akiyama, Toyota; Sadao Wada, Siki; Michihide Tokashiki, Kawagoe, all of Japan

[73] Assignees: Toyota Jidosha Kabushiki Kaisha; Toa Nenryo Kogyo Kabushiki Kaisha, both of Tokyo, Japan

[21] Appl. No.: 762,665

[22] Filed: Aug. 5, 1985

[30] Foreign Application Priority Data

Aug. 7, 1984 [JP] Japan ..... 59-165521
Aug. 9, 1984 [JP] Japan ..... 59-167037

[51] Int. Cl.[4] ..... C10M 101/04
[52] U.S. Cl. ..... 252/56 S; 252/51.5 A
[58] Field of Search ..... 252/56 S, 56 R, 51.5 A

[56] References Cited

U.S. PATENT DOCUMENTS 3,481,873 12/1969 Aylesworth ..... 252/56 S
3,623,987 11/1970 Ker et al. ..... 252/56 S

FOREIGN PATENT DOCUMENTS 0578803 6/1959 Canada ..... 252/56 S
0611382 12/1960 Canada ..... 252/56 S
0621932 6/1961 Canada ..... 252/56 S

*Primary Examiner*—William R. Dixon, Jr.
*Assistant Examiner*—Margaret B. Medley
*Attorney, Agent, or Firm*—Seidel, Gonda, Goldhammer & Abbott

[57] ABSTRACT

A wear-resistant, synthetic lubricating oil composition comprises as a base oil a synthetic oil mixture consisting of (A) a diester of an aliphatic dibasic acid having 4–14 carbon atoms and an alcohol having so many carbon atoms or a mixture of several such diesters and having a viscosity at 100° C. of 2.0–7.0 $mm^2/s$, and (B) a polyoxyalkylene glycol whose alkylene group contains 2–5 carbon atoms or a mixture of several such glycols and having a viscosity at 100° C. of at least 20 $mm^2/s$. The base oil exhibits viscosity values of 9 $mm^2/s$ or above at 100° C. and $6\times10^4$ mPa.s or below at −40° C.

15 Claims, 5 Drawing Figures

SYNTHETIC LUBRICATION OIL COMPOSITIONS

BACKGROUND OF THE INVENTION

This invention relates to synthetic lubricating oil compositions which exhibit desirable viscosity at high temperatures and good fluidity at low temperatures and, moreover, excellent wear resistance. The invention is more particularly concerned with wear-resistant, synthetic lubricating oil compositions based on synthetic oils suited for the lubrication of mechanical superchargers of automobiles.

For greater power output and less fuel consumption by automotive engines, turbochargers and more efficient superchargers have in recent years been rapidly developed. More recently, the development of superchargers quicker to respond than heretofore is actively under way which will overcome the time lag of the turbocharger that uses exhaust gas to drive turbines which, in turn, drive an air compressor (centrifugal type air pump) to supercharge the engine.

Unlike the turbocharger, the supercharger does not exploit the exhaust gas. Its mechanism is such that, as illustrated in FIG. 5, the rotation of the engine crankshaft is transmitted through a toothed belt (not shown) to a pulley 2, and the rotation of the pulley 2 is transmitted through a gear train 4 to an air compressor (positive displacement air pump) 6, whereby air is compressed before being charged into the engine. Usually, the supercharger employs a two-lobe Roots compressor for this purpose and hence is sometimes known as Roots supercharger.

In the manner described the supercharger is directly coupled to the engine, and it offers the advantages of good engine response to the accelerator depression and improved engine efficiency and fuel economy when running in the low-speed range.

The turbocharger and supercharger, operating with different mechanisms as described above, require lubricating oils dissimilar in quality. The former needs heat-resistant oil because it handles hot exhaust gases. The oil for the latter must be resistant not only to heat but also to abrasion under the conditions of high speed running, since the gear-train drive 4 and bearings 8 are subjected to high temperatures (e.g., 150° to 200° C.) and high-speed rotation (e.g., 9,000 rpm).

On the other hand, automobiles should be easily driven by ordinary persons as well as by the skilled. Their parts, gears, and mechanisms must work jointly to enable the vehicles to start and run smoothly in varied driving environments, hot or cold.

Thus, the lubricating oil for the supercharger must meet the following essential requirements:

(1) High stability at elevated temperatures (about 100° C.) and high-speed rotations (e.g., 9,000 rpm)
(2) Good fluidity at low temperatures (e.g., −40° C.)
(3) Good wear resistance
(4) Freedom from maintenance
(5) Minimum oil volume Lubricating oils introduced so far for use over relatively wide temperature ranges have included, for example, a hydraulic oil composition based on an ester mixture described in the specification of Japanese Patent Application Public Disclosure No. 127484/1977. However, the base oil solidifies at low temperatures, e.g., between 0° and −20° C., and lacks the low-temperature fluidity required of the base oil for the lubricating oil of the present invention. Mineral lubricating oils with high degrees of low-temperature fluidity are already in use, e.g., as automatic transmission fluids. They are not as viscous as high temperatures, however, and are not capable of service under high-speed operating conditions that demand accordingly high wear resistance.

For use in gas turbines of aircraft, there have been proposed, and have come into use, synthetic lubricating oil compositions based on diesters and thickened with polyglycol ethers [U.S. Pat. No. 2,944,973; Journal of the Institute of Petroleum, 47, 446, P. 42 (Feb., 1961); ibid., 50, 491, p. 284 (Nov., 1964)]. However, these synthetic oils have viscosities of only about 7.5 $mm^2/s$ at 100° C. and are not effective for the high-performance superchargers of internal combustion engines recently developed or under development.

Out of the lubricating oils on the market, apparently utilizable for automotive superchargers are "ATF-DII" (automatic transmission fluid of the "Dexron II" grade) and gear oil with a service viscosity range of 75W-90. The former exhibits favorable low-temperature fluidity but inadequate viscosity at high temperatures. The latter is adequately viscous at high temperatures but has a drawback of excessive viscosity and poor fluidity at low temperatures. (Refer to FIG. 1.) Moreover, the latter lubricating oil, 75W-90, requires the addition of a viscosity index improver to enhance its high-temperature viscosity at the expense of wear resistance.

None of the commercially available lubricating oils have been found capable of combining good viscosity at high temperatures (e.g., 100° C.) with good fluidity at low temperatures (e.g., −40° C.) without the incorporation of a viscosity index improver.

Conventional lubricating oils, usually based on mineral oils, deteriorate so rapidly that frequent oil replacement is necessary. In an effort to retard the mineral oil deterioration it has been customary to circulate a large volume of the oil composition.

As will be understood from the foregoing, the lubricating oil compositions taught by the above-mentioned patent were defective in that the base oil solidifies at low temperatures, e.g., at 0° to −20° C., or fails to remain sufficiently viscous at elevated temperatures for service under the conditions of high-speed rotation. Also, among the automatic transmission fluids and gear oils in use, there is not a single product excellent in all three essential properties; low-temperature fluidity, high-temperature viscosity, and wear resistance.

It is therefore a principal object of the present invention to provide a wear-resistant synthetic lubricating oil having a lower rate of viscosity variation than conventional oils with a wide range of temperature changes.

To be more exact, the invention has for an object the provision of a wear-resistant, synthetic lubricating oil composition which possesses good high-temperature stability and low-temperature fluidity, for example, combining the high-temperature viscosity of the 75W-90 gear oil with the low-temperature fluidity of "ATF-DII", and yet requires no addition of a viscosity index improver.

Another object of the invention is to provide a wear-resistant, synthetic lubricating oil composition, usable particularly for automotive superchargers, which is resistant to heat and wear under high-speed running conditions and maintenance-free or capable of service for long periods without the need of replacement under conditions of high-speed rotation (e.g., 9,000 rpm) at oil temperatures between 150° and 200° C.

SUMMARY OF THE INVENTION

In order to realize the above objects of the invention, we have investigated about synthetic oils having good viscosity indexes. As a result, our attention has been directed to diesters having good low-temperature fluidity and polyoxyalkylene glycols having good high-temperature viscosity characteristics.

Diesters show low viscosity values at high temperatures whereas polyoxyalkylene glycols exhibit low fluidity values at low temperatures. However, it has now been found that a base oil for lubricating oil composition which possesses good low-temperature fluidity despite an increased high-temperature viscosity can be produced by mixing specifically a polyoxyalkylene glycol or glycols having a viscosity at 100° C. of at least 20 $mm^2/s$ with a diester or diesters in such a manner that the viscosity of the base oil consisting of such a synthetic oil mixture comes within a specific range.

In brief, our research has now revealed that a synthetic lubricating oil composition can be produced which has desirable high-temperature viscosity characteristics, good low-temperature fluidity, and excellent wear resistance when the composition uses as its base oil a synthetic oil mixture consisting of (A) a diester of an aliphatic dibasic acid having 4 to 14 carbon atoms in the molecule and an alcohol having 4 to 14 carbon atoms or a mixture of several such diesters and having a viscosity at 100° C. of 2 to 7 $mm^2/s$, and (B) a polyoxyalkylene glycol whose alkylene group contains 2 to 5 carbon atoms or a mixture of several such glycols and having a viscosity at 100° C. of at least 20 $mm^2/s$, the base oil exhibiting viscosity values of 9 $mm^2/s$ or above at 100° C. and $6\times10^4$ mPa.s or below at −40° C.

The factor that has provided the most important basis for the present invention is our finding that when a diester and a polyoxyalkylene glycol are mixed the resulting base oil as a synthetic oil mixture of the two shows a better high-temperature (100° C.) characteristic than is expected from the viscosity of the diester or polyoxyalkylene glycol alone and yet the low-temperature (−40° C.) viscosity of the base oil becomes fairly low and that this tendency is pronounced when the base oil uses a polyoxyalkylene glycol whose viscosity at 100° C. is 20 $mm^2/s$ or upward.

After further investigations we have found that a desirable diester is diisodecyl adipate and a desirable polyoxyalkylene glycol is polypropylene glycol and that the two, when mixed in a specific ratio under specific conditions, yield a lubricating oil, or a base for lubricating oil, that possesses good low-temperature fluidity despite an increased high-temperature viscosity.

Our study has now led to the conclusion that a synthetic lubricating oil composition having great high-temperature viscosity characteristic, good low-temperature fluidity, and excellent wear resistance and particularly suited for the lubrication of superchargers can be obtained by employing as its base oil a synthetic oil mixture consisting of 80 to 40% by weight of diisodecyl adipate and 20 to 60% by weight of polypropylene glycol having a viscosity at 100° C. of at least 20 $mm^2/s$, the viscosity of the base oil being 9 $mm^2/s$ or above at 100° C. and $6\times10^4$ mPa.s or below at −40° C.

DETAILED DESCRIPTION OF THE INVENTION

Figure 1:
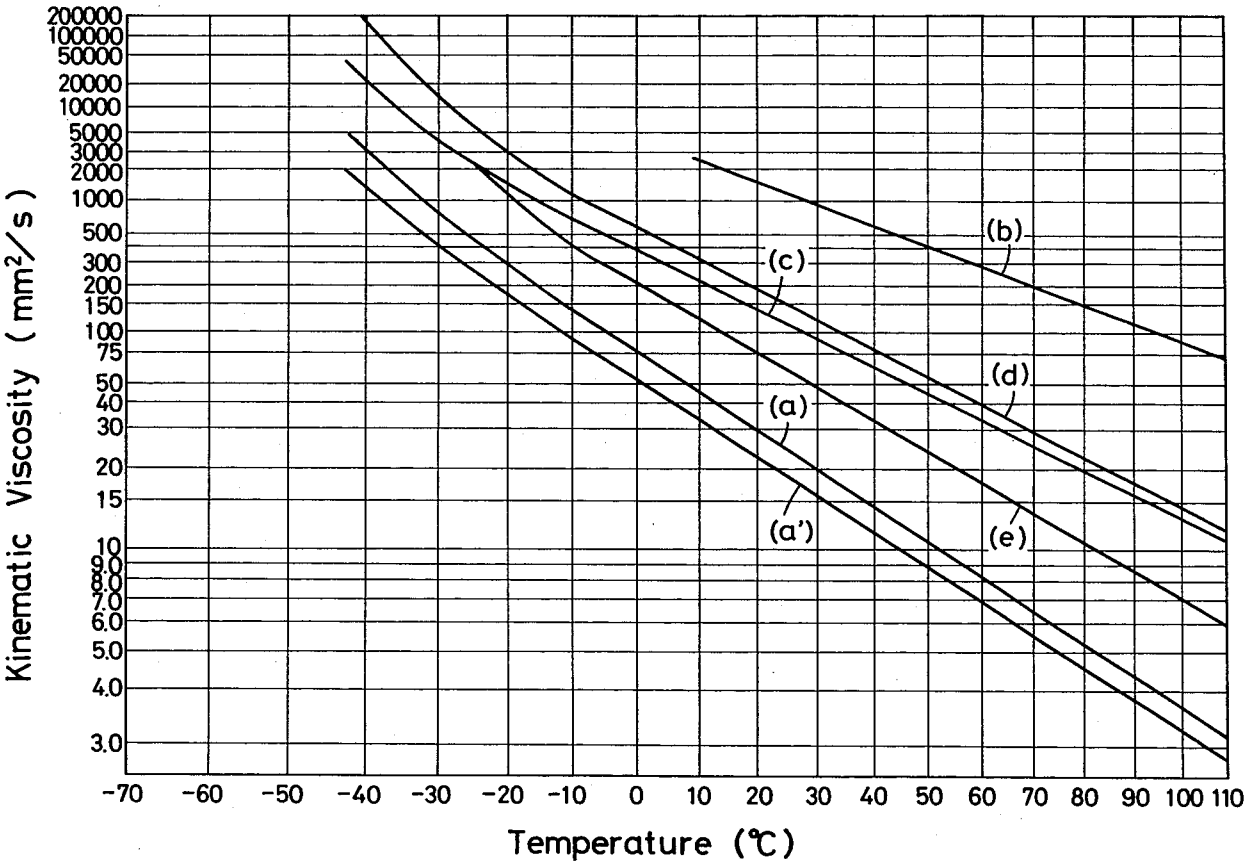
FIG. 1 is a graph showing the viscosity characteristics of a mixed base oil for synthetic lubricating oil according to the present invention, essential ingredients therefor, and of conventional lubricating oils.

FIG. 1 is a graph showing the viscosity characteristics of diesters, e.g., diisodecyl adipate (a) and di-(2-ethylhexyl) sebacate (a'), a polyoxyalkylene glycol, e.g., polypropylene glycol (b), and a base oil for lubricating oil composition embodying the invention (e.g., 65% diisodecyl adipate and 35% polypropylene glycol) (c). It will be appreciated from this graph that the base oil according to the invention exhibits a better high-temperature (100° C.) viscosity characteristic than is expected from the viscosity of either diester or polyoxyalkylene glycol alone but it nevertheless shows a relatively low viscosity at the low temperature (−40° C.).

It will also be understood from a comparison with the conventional lubricating oils also shown in FIG. 1, i.e., the 75W-90 gear oil (d) and "ATF-DII" (e) that the base oil (c) of the invention gives better results over a considerably wide range of viscosity characteristics.

Our research has made it clear that, in order to attain the desirable properties of the lubricating oil for superchargers, i.e., of the base oil for synthetic lubricating oil that satisfies the above-mentioned conditions (1) to (5), it is of prime importance to mix the diester and the polyoxyalkylene glycol so that the resulting base oil acquires a viscosity of 9 $mm^2/s$ or upward, preferably 10 to 17 $mm^2/s$, at 100° C. and $6\times10^4$ mPa.s or below at −40° C.

Even a lubricating oil based on a diester-polyoxyalkylene glycol mixture will cause excessive wear of the supercharger if the base oil viscosity at 100° C. is too low. The viscosity range in conformity with the invention provides adequate wear resistance. On the other hand, an excessive viscosity at 100° C. will result in an increased power loss due to friction. The low-temperature viscosity is desired to be as low as possible to facilitate the start of the automotive engine and minimize wasting of energy.

As is clear from the foregoing, the present invention is characterized by in that a base oil is prepared by mixing a diester with a polyoxyalkylene glycol having a viscosity of not less than a specific value (20 $mm^2/s$) and that the mixing of the diester with the polyoxyalkylene glycol is accomplished in such a manner that a synthetic oil mixture, or base oil, having the viscosity specified above is obtained.

To be more specific, the diesters and polyoxyalkylene glycols that may constitute the base oil for synthetic lubricating oil composition according to the invention are as follows.

The diesters are formed by the synthesis of an aliphatic dibasic acid having 4 to 14 carbon atoms and a monohydric alcohol having 4 to 14 carbon atoms. Examples of such dibasic acids are succinic, glutaric, adipic, piperic, suberic, azelaic, sebacic, undecanedioic, dodecanedioic, brassylic, and tetradecanedioic acids, preferably adipic, azelaic, and sebacic acids, and more preferably azelaic and sebacic acids. Examples of the monohydric alcohols are n-butanol, isobutanol, n-amyl alcohol, isoamyl alcohol, n-hexanol, 2-ethylbutanol, cyclohexanol, n-heptanol, isoheptanol, methylcyclohexanol, n-octanol, dimethylhexanol, 2-ethylhexanol, 2,4,4-trimethylpentanol, isooctanol, 3,5,5-trimethylhexanol, isononanol, isodecanol, tridecanol, and isotetradecanol, preferably 2-ethylhexanol and isodecanol. Dihydric alcohols may also be employed.

Synthesis of a diester from a dibasic acid and an alcohol may be accomplished in the usual way, for example, by dehydrative condensation in the presence of an acid catalyst. Examples of such diesters are di(1-ethylpropyl) adipate, di(3-methylbutyl) adipate, di(1,3-dimethylbutyl) adipate, di(2-ethylbutyl) adipate, di(2-ethylhexyl) adipate, di(isooctyl) adipate, di(isononyl) adipate, di(undecyl) adipate, di(tridecyl) adipate, di(isotetradecyl) adipate, di(2,2,4-trimethylpentyl) adipate, di[mixed (2-ethylhexyl-isononyl)] adipate, di(1-ethylpropyl) azelate, di(3-methylbutyl) azelate, di(2-ethylbutyl) azelate, di(2-ethylhexyl) azelate, di(isooctyl) azelate, di(isononyl) azelate, di(isodecyl) azelate, di(tridecyl) azelate, di[mixed (2-ethylhexyl-isononyl)] azelate, di[mixed (2-ethylhexyldecyl)] azelate, di[mixed (2-ethylhexyl-isodecyl)] azelate, di[mixed (2-ethylhexyl-2-propylheptyl)] azelate, di[mixed (2-methylpentyl-decyl)] azelate, di(n-butyl) sebacate, di(isobutyl) sebacate, di(1-ethylpropyl) sebacate, di(3-methylbutyl) sebacate, di(1,3-dimethylbutyl) sebacate, di(1,3-dimethylbutyl) sebacate, di(2-ethylbutyl) sebacate, di(2-ethylhexyl) sebacate, di[2-(2'-ethylbutoxy)ethyl] sebacate, di(2,2,4-trimethylpentyl) sebacate, di(isononyl) sebacate, di(isodecyl) sebacate, di(isoundecyl) sebacate, di(tridecyl) sebacate, di(isotetradecyl) sebacate, di[mixed (2-ethylhexyl-isononyl)] sebacate, di(2-ethylhexyl) glutarate, di(isoundecyl) glutarate, and di(isotetradecyl) glutarate.

The polyoxyalkylene glycol is a ring-opening polymerization or copolymerization product of a straight- or branched-chain alkylene oxide in which the alkylene group contains 2 to 5 carbon atoms, preferably 2 or 3 carbon atoms. The alkylene oxide is ethylene oxide, propylene oxide, butylene oxide, or their mixture, preferably propylene oxide.

Diesters and polyoxyalkylene glycols are available with varied viscosities depending on the degrees of dehydrative condensation or ring-opening polymerization achieved. For the purposes of this invention, the diester is required to have a viscosity at 100° C. of 2.0 to 7.0 $mm^2/s$ and the polyoxyalkylene glycol a viscosity at the same temperature of at least 20 $mm^2/s$.

If the viscosity of the diester is too low the resulting base oil have problems of inadequate flash point, volatility, and load-carrying capacity. Conversely if the viscosity is too high the mixing effect will be lessened. A polyoxyalkylene glycol of a too low viscosity will weaken the mixing effect, either, as already stated.

According to the present invention, the lubricating oil composition is based on one or several such diesters as a mixture and one or several such polyoxyalkylene glycols as a mixture. In addition, as a product oil, it may contain additives, such as an antioxidant (0.5–5 wt%), extreme pressure agent (0.5–10 wt%), metal deactivator (0.01–2 wt%), rust inhibitor (0.05–1wt%), oiliness agent (0.01–1 wt%), and antifoaming agent (0.0005–0.01 wt%), in a total amount of about 5 to 10% by weight.

Our studies have shown that, for the satisfaction of the property requirements of the lubricating oil composition for superchargers, the following is of great importance. For example, diisodecyl adipate and polypropylene glycol representing the two major ingredients must be mixed in a specific ratio, 80 to 40% by weight of the former to 20 to 60% by weight of the former. Moreover, the two must be mixed so that the resulting synthetic oil mixture, or base oil, can have a viscosity at 100° C. of at least 9 $mm^2/s$, preferably in the range of 10 to 17 $mm^2/s$, and $6\times10^4$ mPa.s or below at −40° C.

Even a diisodecyl adipate-polypropylene glycol mixture will cause excessive wear of the actual supercharger, as stated above, if its viscosity at 100° C. is too low. The mixture within the viscosity range according to the invention, by contrast, contributes sufficient wear resistance. A too high viscosity at 100° C. will result in an increased power loss due to friction. The low-temperature viscosity is desired to be the lowest possible to make the automotive engine easier to start and minimize the energy loss.

Polypropylene glycol is available with varied viscosities depending on the degree of ring-opening polymerization of the propylene oxide alone or of propylene oxide containing 10% or less ethylene oxide. Under the invention, as noted above, it is imperative that the viscosity at 100° C. be at least 20 $mm^2/s$. Too low a polypropylene glycol viscosity will lessen the favorable mixing effect, as stated already.

As will be obvious from the foregoing description, a preferred embodiment of the invention is characterized by the base oil prepared by mixing 80 to 40% by weight of diisodecyl adipate with 20 to 60% by weight of polypropylene glycol. As additives, it contains at least an extreme pressure agent (0.5–10 wt%) and may further contain antioxidant (0.5–5wt%), metal deactivator (0.01–2 wt%), rust inhibitor (0.05–1 wt%), antifoaming agent (0.0005–0.05 wt%), oiliness agent (0.05–1 wt%) and the like. Altogether, these additives are used in an amount of 5 to 10% by weight, preferably 6 to 8% by weight, on the basis of the total weight of the resulting lubricating oil.

Figure 2:
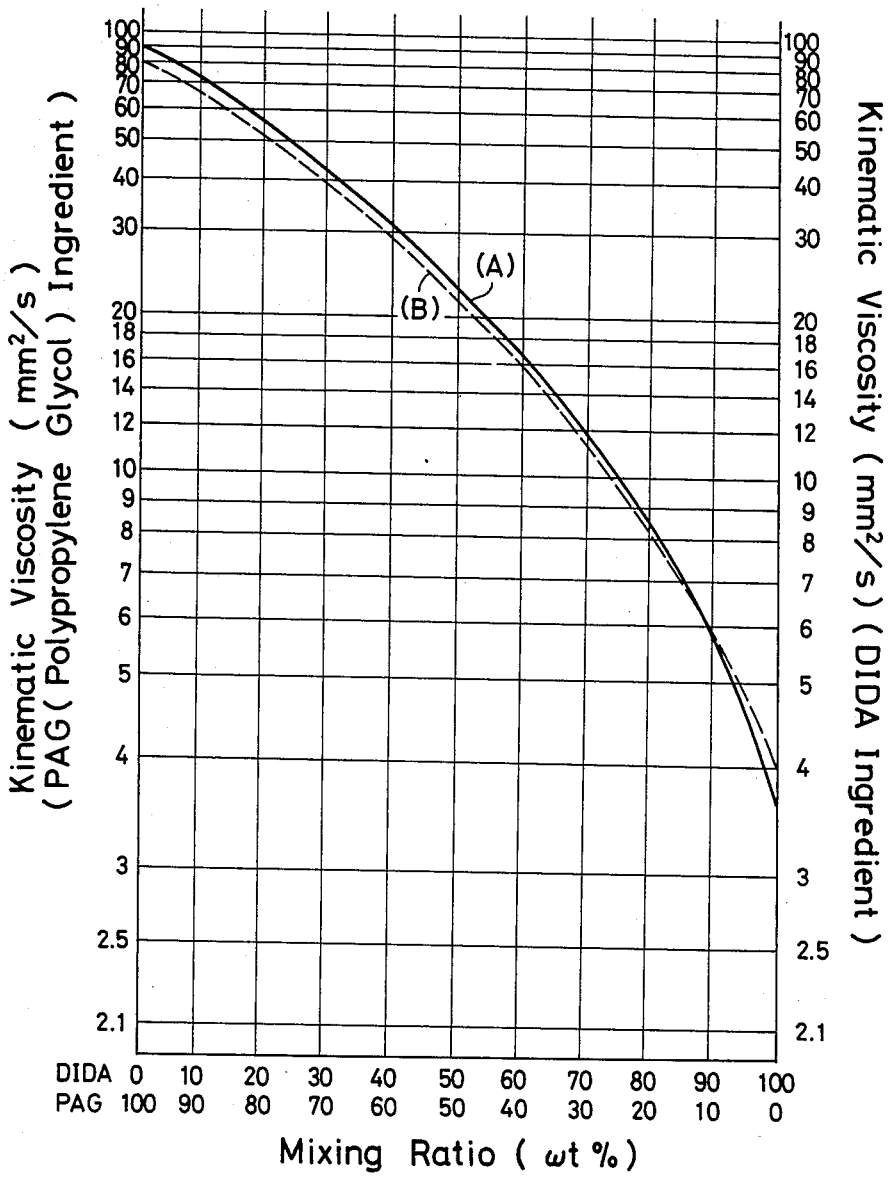
FIGS. 2 and 3 are graphs showing the viscosity characteristics of the mixed base oil and product oil of the invention measured at 100° C. and −40° C., respectively.
Figure 3:
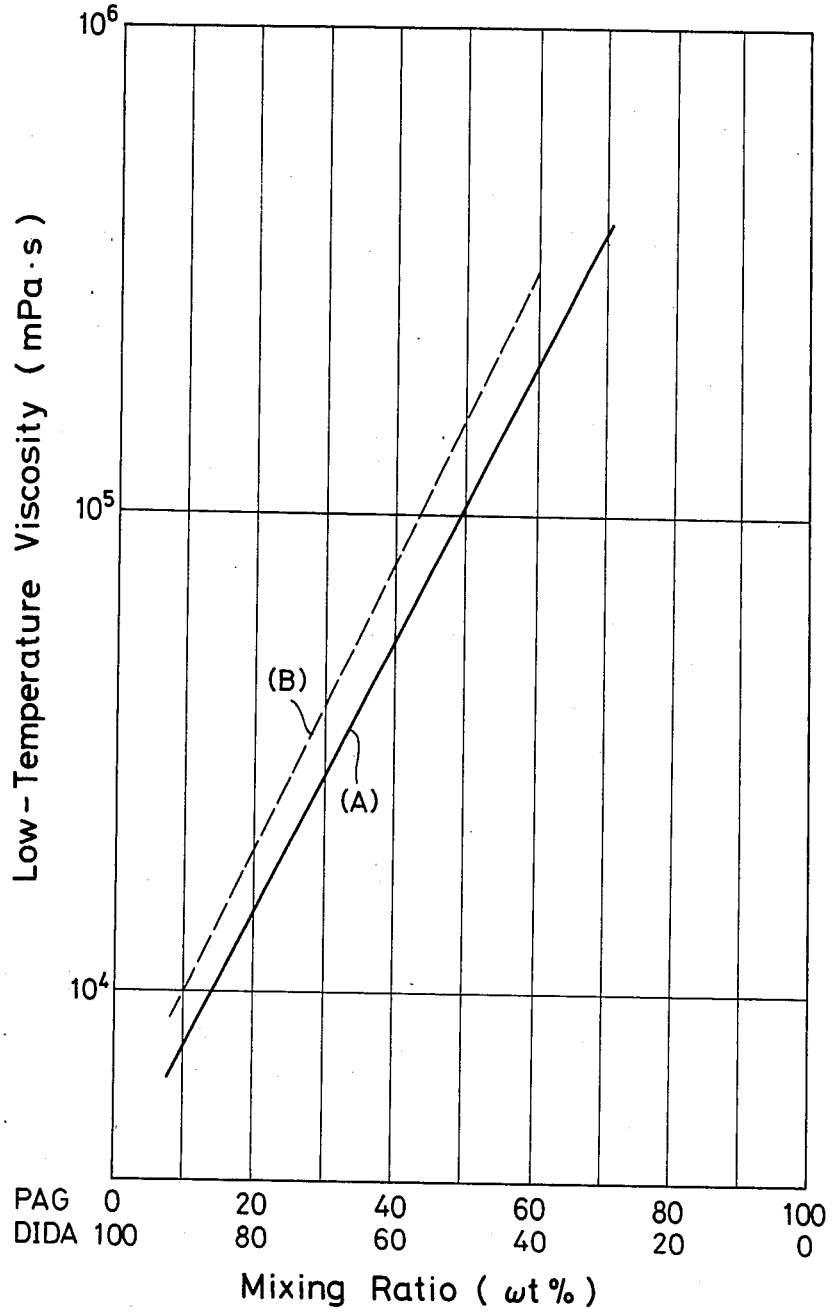

There are shown in FIGS. 2 and 3 the relations between the viscosity characteristic of the base oil for lubricating oil (A) and the viscosity characteristic of the product oil containing the above-mentioned additives (B).

FIG. 2 graphically represents the viscosities at 100° C. of the mixed base oil of diisodecyl adipate and polypropylene glycol at varied mixing ratios and of the product oil using the base oil. The graph indicates that at 100° C. the mixed base oil is more visous than the product oil but generally the same viscosity tendency holds.

FIG. 3 graphically represents the viscosities at −40° C. of the mixed base oil of diisodecyl adipate and polypropylene glycol at varied mixing ratios and of the product oil based on the mixture. The graph shows that at −40° C. the product oil is more viscous than the mixed base oil at whatever mixing ratio.

As is evident from FIGS. 2 and 3, the viscosity of the product oil using the base oil according to the invention is 3.5 $mm^2/s$ or above at 100° C. and 90,000 mPa.s or below at −40° C.

The present invention is illustrated by the following examples in which lubricating oil compositions embodying the invention were prepared.

EXAMPLE 1

As a diester, one of the essential ingredients to constitute the composition of the invention, diisodecyl adipate (DIDA) was chosen. As the other ingredient polyoxyalkylene glycol, polypropylene glycol was chosen. The viscosity characteristics of these ingredients were as given in Table 1.

The viscosity values at 100° C. are those measured with an Ubbellohde viscometer (in conformity with JIS K2283). The viscosity at −40° C. was measured with a Brookfield viscometer (ASTM D-2983).

TABLE 1

| | Viscosity at 100° C. ($mm^2/s$) | Viscosity at −40° C. (mPa · s) |
|---|---|---|
| Diisodecyl adipate (DIDA) | 3.68 | 3,450 |
| Polypropylene glycol (average molecular weight; 2,800) | 88.86 | Solidified |

The DIDA and polypropylene glycol shown in Table 1 were mixed at varying ratios of 80/20, 75/25, 70/30, 65/35, 60/40, 50/50, and 40/60 (% by weight) to prepare compositions A, B, C, D, E, F, and G. Table 2 gives the viscosity characteristics of these compositions and of the conventional lubricating oil "ATF-DII" and 75W-90 gear oil.

EXAMPLE 2

The synthetic lubricating oil compositions A through G prepared in Example 1 were allowed to contain the same amounts of additives.

TABLE 2

| | Viscosity at 100° C. ($mm^2/s$) | Viscosity at −40° C. (mPa · s) |
|---|---|---|
| Composition A | 8.48 (8.12) | 14,700 (19,300) |
| Composition B | 9.40 (9.10) | 20,300 (28,000) |
| Composition C | 11.75 (11.50) | 29,000 (41,000) |
| Compositon D | 13.98 (13.50) | 41,000 (55,000) |
| Composition E | 16.50 (15.74) | 55,000 (81,000) |
| Composition F | 23.00 (21.43) | 107,000 (159,000) |
| Composition G | 30.20 (28.60) | 205,000 (300,000) |
| ATF-DII | 4.30 (7.21) | Solidified (42,000) |
| 75W-90 Gear oil | 4.20 (14.20) | Solidified (148,000) |

Note:
The mechanical values given within the parentheses represent the viscosities of the product oils. As additives, 0.5 to 10% by weight of tricresyl phosphate (EP agent) etc. were added.

The resulting product oils having the viscosity characteristics as shown in Table 2 were tested with superchargers under actual operating conditions. The superchargers were operated at an oil temperature of 150° C. and at an air compressor rotor speed of 8,250 rpm for 200 hours. The test results are summarized in Table 3. It can be seen from the table that the composition A contains as much as 210 ppm Fe etc. whereas the contents sharply decrease in the compositions B through G and that, therefore, a viscosity at 100° C. of at least 9 $mm^2/s$ is required.

TABLE 3

| Oil tested | 75W-90 Gear oil | ATF-DII | Synthetic lubricating oil composition A | B | C | D | E | F | G |
|---|---|---|---|---|---|---|---|---|---|
| Elemental analysis of used oil Fe (ppm) | 680 | 341 | 210 | 89 | 50 | 36 | 30 | 25 | 24 |
| Loss of torque Kgf · m | 0.30 | 0.03 | — | — | 0.02 | 0.03 | 0.10 | 0.32 | 0.80 |

At the same time, the viscosity characteristics of the conventional lubricating oils, i.e., the 75W-90 gear oil and "ATF-DII", were determined. Table 4 gives the results.

TABLE 4

| Viscosity | 100° C. ($mm^2/s$) | −40° C. (mPa · s) |
|---|---|---|
| AFT-DII | 7.21 | 42,000 |
| 75W-90 Gear oil | 14.20 | 148,000 |

Figure 4:
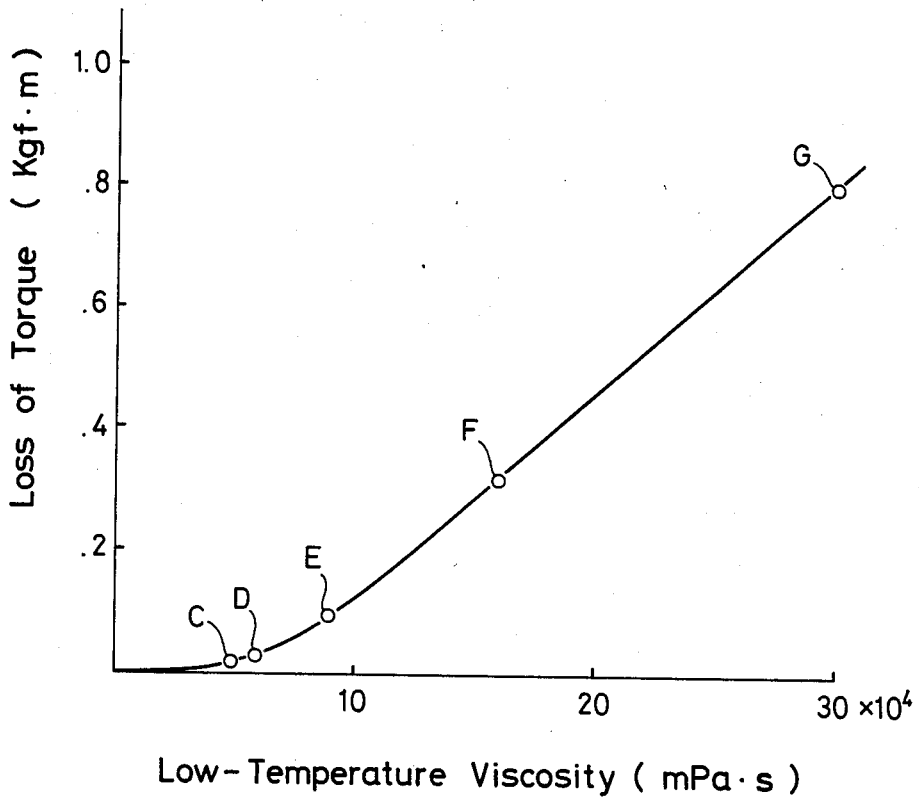
FIG. 4 is a graph showing the relation between the viscosity at a low temperature of the mixed base oil and the loss of torque.
Figure 5:
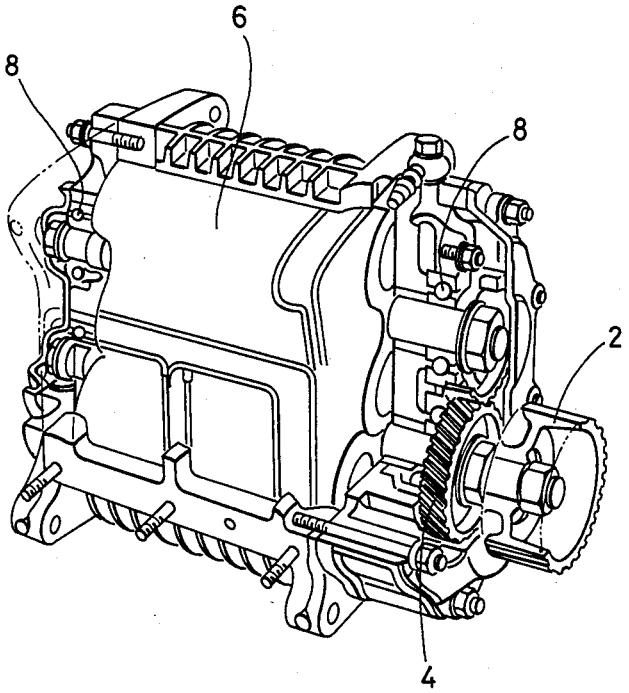
FIG. 5 is a partly broken perspective view of a supercharger for automobile.

The loss of torque was measured in the following way. The gear box of each supercharger was filled with 100 ml of a given test oil. The supercharger was kept stationary at −40° C. for 8 hours, and its pulley was driven by a torque wrench, and then the torque during rotation was measured. FIG. 4 graphically represents the results of measurements of torques lost. It will be understood from Tables 1 to 3 and FIG. 4 that a base oil should have a high-temperature (100° C.) viscosity of at least 9 $mm^2/s$ and a low-temperature (−40° C.) viscosity of $6\times10^4$ mPa.s or below (corresponding in the viscosity characteristics to the compositions B to E). Also, as is obvious from Table 3, the synthetic lubricating oil compositions F and G have low Fe contents but, as noted above, exhibit high low-temperature viscosities (hence involving much losses of torque) and are of little practical value since it makes the engine difficult to start.

The ordinary lubricating oils, the 75W-90 gear oil and "ATF-DII", contain much Fe, indicating very poor wear resistance.

Table 5 summarizes the viscosity characteristics of base oils (and product oils) in different mixing ratios of diisodecyl adipate (DIDA) as a diester to polypropylene glycol varying in viscosity values, as determined by the viscosity of the glycol.

The viscosity characteristics of the diester employed in this series of tests were as shown in Table 7.

TABLE 5

| DIDA wt % | Polypropylene glycol wt % | Polypropylene glycol 100° C. ($mm^2/s$) | 100° C. ($mm^2/s$) Base oil | 100° C. ($mm^2/s$) Product oil | −40° C. (mPa · s) Base oil | −40° C. (mPa · s) Product oil |
|---|---|---|---|---|---|---|
| 90 | 10 | 15.00 | — | — | — | — |
| 80 | 20 | " | — | — | — | — |
| 70 | 30 | " | — | — | — | — |
| 60 | 40 | " | 6.60 | — | 17,500 | — |
| 50 | 50 | " | 7.57 | 7.35 | 26,500 | 37,000 |
| 45 | 55 | " | 8.05 | 7.85 | 33,500 | 47,000 |
| 40 | 60 | " | 8.70 | 8.45 | 42,000 | 61,000 |
| 35 | 65 | " | 9.30 | 9.00 | 53,000 | 86,000 |
| 30 | 70 | " | 9.92 | 9.60 | 66,000 | 98,000 |
| 90 | 10 | 19.56 | 4.37 | 4.59 | — | 6,200 |
| 80 | 20 | " | 5.10 | 5.23 | 7,800 | 10,200 |
| 70 | 30 | " | 6.11 | 6.10 | 12,300 | 16,500 |
| 60 | 40 | " | 7.21 | 7.00 | 19,800 | 27,000 |
| 50 | 50 | " | 8.45 | 8.05 | 32,500 | 44,000 |
| 45 | 55 | " | 9.15 | 8.82 | 40,000 | 56,000 |
| 40 | 60 | " | 9.95 | 9.42 | 50,000 | 72,000 |
| 35 | 65 | " | 10.80 | 10.45 | 61,000 | 93,000 |
| 90 | 10 | 30.00 | 4.75 | 4.86 | — | 7,200 |
| 80 | 20 | " | 5.97 | 5.99 | 9,600 | 12,600 |
| 70 | 30 | " | 7.46 | 7.40 | 16,200 | 22,100 |
| 65 | 35 | " | 8.13 | 7.90 | 21,500 | 29,500 |
| 60 | 40 | " | 9.24 | 8.93 | 27,400 | 38,300 |
| 55 | 45 | " | 10.20 | 9.90 | 36,000 | 51,000 |
| 50 | 50 | " | 11.40 | 10.80 | 47,500 | 66,000 |
| 45 | 55 | " | 12.50 | 12.10 | 61,000 | 87,000 |
| 90 | 10 | 53.00 | 5.24 | 5.20 | — | 8,600 |
| 80 | 20 | " | 7.21 | 7.06 | 12,100 | 16,000 |
| 75 | 25 | " | 8.20 | 7.90 | | |
| 70 | 30 | " | 9.50 | 9.34 | 22,200 | 31,000 |
| 65 | 35 | " | 10.90 | 10.50 | 30,000 | 42,000 |
| 60 | 40 | " | 12.60 | 12.10 | 40,100 | 58,000 |
| 55 | 45 | " | 14.30 | 13.80 | 55,000 | 80,000 |
| 50 | 50 | " | 16.50 | 15.50 | 74,000 | 106,000 |
| 90 | 10 | 88.86 | 5.69 | 5.51 | 7,800 | 10,000 |
| 80 | 20 | " | 8.48 | 8.12 | 14,700 | 19,400 |
| 75 | 25 | " | 9.40 | 9.10 | 20,300 | 28,000 |
| 70 | 30 | " | 11.75 | 11.50 | 29,000 | 41,000 |
| 65 | 35 | " | 13.98 | 13.50 | 41,000 | 55,000 |
| 60 | 40 | " | 16.50 | 15.74 | 55,000 | 81,000 |
| 55 | 45 | " | 19.80 | 18.90 | 76,000 | 113,000 |
| 50 | 50 | " | 23.00 | 21.43 | 167,000 | 159,000 |
| 90 | 10 | 146.00 | 5.97 | 6.00 | 9,000 | 12,000 |
| 80 | 20 | " | 9.50 | 8.92 | 20,000 | 27,800 |
| 70 | 30 | " | 14.60 | 13.80 | 44,500 | 63,000 |
| 60 | 40 | " | 21.10 | 20.10 | 96,000 | 147,000 |
| 50 | 50 | " | 29.80 | 27.90 | 228,000 | 335,000 |

TABLE 6

| DOS wt % | Polypropylene glycol wt % | Polypropylene glycol 100° C. ($mm^2/s$) | 100° C. ($mm^2/s$) Base oil | 100° C. ($mm^2/s$) Product oil | −40° C. (mPa · s) Base oil | −40° C. (mPa · s) Product oil |
|---|---|---|---|---|---|---|
| 90 | 10 | 15.00 | — | | — | |
| 80 | 20 | " | — | | — | |
| 70 | 30 | " | — | | — | |
| 60 | 40 | " | 6.25 | | 13,500 | |
| 45 | 55 | " | 7.30 | | 22,500 | |
| 40 | 60 | " | 8.40 | | 37,000 | 53,000 |
| 35 | 65 | " | 9.01 | 8.70 | 47,000 | 69,000 |
| 30 | 70 | " | 9.75 | 9.40 | 62,000 | 88,000 |
| 25 | 75 | " | 10.30 | 9.95 | 78,000 | 107,000 |
| 90 | 10 | 19.51 | 4.05 | 4.35 | — | 4,500 |
| 80 | 20 | " | 4.80 | 5.05 | 5,600 | 7,500 |
| 70 | 30 | " | 5.80 | 5.90 | 9,200 | 13,000 |
| 60 | 40 | " | 6.85 | 6.75 | 15,500 | 21,800 |
| 50 | 50 | " | 8.10 | 7.90 | 26,300 | 37,000 |
| 45 | 55 | " | 8.80 | 8.50 | 34,000 | 48,000 |
| 40 | 60 | " | 9.70 | 9.23 | 43,500 | 62,000 |
| 35 | 65 | " | 10.40 | 10.0 | 56,000 | 80,000 |
| 30 | 70 | " | 11.30 | 10.90 | 74,000 | 105,000 |
| 90 | 10 | 30.00 | 4.41 | 4.68 | — | 5,200 |
| 80 | 20 | " | 5.64 | 5.79 | 7,300 | 9,700 |

TABLE 6-continued

| DOS wt % | Polypropylene glycol wt % | Polypropylene glycol 100° C. ($mm^2/s$) | 100° C. ($mm^2/s$) Base oil | 100° C. ($mm^2/s$) Product oil | −40° C. (mPa · s) Base oil | −40° C. (mPa · s) Product oil |
|---|---|---|---|---|---|---|
| 70 | 30 | " | 7.20 | 7.21 | 13,100 | 18,300 |
| 60 | 40 | " | 8.88 | 8.67 | 23,700 | 33,900 |
| 50 | 50 | " | 10.70 | 10.50 | 43,100 | 64,000 |
| 40 | 60 | " | 13.50 | 12.80 | 74,000 | — |
| 90 | 10 | 53.00 | 4.85 | 5.07 | — | 6,200 |
| 80 | 20 | " | 6.79 | 6.77 | 9,900 | 12,800 |
| 70 | 30 | " | 9.26 | 9.10 | 19,300 | 26,700 |
| 60 | 40 | " | 12.10 | 11.70 | 38,100 | 55,800 |
| 50 | 50 | " | 15.20 | 14.80 | 75,200 | 99,000 |
| 90 | 10 | 88.86 | 5.25 | 5.41 | — | 7,100 |
| 80 | 20 | " | 7.95 | 7.83 | 12,700 | 16,100 |
| 70 | 30 | " | 11.50 | 11.10 | 26,600 | 36,500 |
| 60 | 40 | " | 15.80 | 15.10 | 56,500 | 78,000 |
| 50 | 50 | " | 20.70 | 20.00 | 119,000 | — |
| 90 | 10 | 146.00 | 5.65 | 5.75 | — | 8,000 |
| 80 | 20 | " | 9.25 | 8.75 | 16,000 | 20,000 |
| 70 | 30 | " | 14.25 | 13.50 | 36,0000 | 49,000 |
| 60 | 40 | " | 20.6 | 19.50 | 82,000 | 124,000 |
| 50 | 50 | " | 28.2 | 27.00 | 185,000 | — |

TABLE 7

| Viscosity | 100° C. ($mm^2/s$) | −40° C. (mPa · s) |
|---|---|---|
| DIDA | 3.68 | 3,450 |
| DOS | 3.27 | 1,330 |

As can be seen from Table 5, a base oil conforming to the present invention is offered by the polypropylene glycol having a viscosity at 100° C. of 20 $mm^2/s$ or above, and the effective mixing ratios of diisodecyl adipate to polypropylene glycol are in the ranges shown in Table 8.

TABLE 8

| Polypropylene glycol viscosity at 100° C. ($mm^2/s$) | Effective mixing ratio wt % ratio |
|---|---|
| 15.00 | — |
| 19.56 | 45/55~35/65 |
| 30.00 | 60/40~45/55 |
| 53.00 | 70/30~55/45 |
| 88.86 | 75/25~65/35 |
| 146.00 | 80/20~70/30 |

Turning back to Table 5, the viscosity of the base oil sometimes comes within the range intended by the invention even when the viscosity at 100° C. of the polypropylene glycol is 15.00 $mm^2/s$. In that case, however, the controllable range of mixing of the glycol with diisodecyl adipate is so narrow that manufacturing the desired base oil in a stable manner is next to impossible, and such a combination is impractical.

EXAMPLE 3

Table 6 summarizes the viscosity characteristics of base oils (and product oils) in different mixing ratios of di(2-ethylhexyl) sebacate (DOS), used in place of the diisodecyl adiptate (DIDA) as a diester, to polypropylene glycol varying in viscosity values, as determined by the viscosity of the glycol.

The viscosity characteristics of the diester used in the tests are given in Table 7.

The di(2-ethylhexyl) sebacate (DOS) and the polypropylene glycol exhibiting a viscosity at 100° C. of 53.00 $mm^2/s$ were mixed in different ratios to prepare synthetic lubricating oil compositions a to f. The same additives were added in the same amounts, and the product oils thus obtained as in Table 9 were tested with superchargers in actual operation under conditions identical to those used in Example 2. The test results are given in Table 10.

Referring to Table 6 (as well as in Table 5), the viscosity of the base oil sometimes fall within the contemplated range of the invention even when the 100° C. viscosity of the polypropylene glycol is 15.00 $mm^2/s$. However, the controllable range within which the glycol is mixed with the diester is too narrow for stable manufacture of the desired base oil and this combination is impractical.

TABLE 9

| Viscosity | 100° C. ($mm^2/s$) | −40° C. (mPa · s) |
|---|---|---|
| Composition a | 6.79 (6.77) | 9,900 (12,800) |
| b | 9.26 (9.10) | 19,300 (26,700) |
| c | 12.10 (11.70) | 38,100 (55,800) |
| d | 15.20 (14.80) | 75,200 (99,000) |
| e | 20.00 (18.90) | 150,000 (198,000) |
| f | 25.30 (23.40) | 290,000 (390,000) |

Note:
The numerical values given within the parentheses represent the viscosities of the product oils. As additives, 0.5 to 10% by weight of tricresyl phosphate (EP agent) etc. were added.

TABLE 10

| Oil tested | Synthetic lubricating oil composition a | b | c | d | e | f |
|---|---|---|---|---|---|---|
| Elemental analysis of used oil Fe (ppm) | 300 | 110 | 44 | 32 | 25 | 25 |
| Loss of torque Kgf · m | 0.01 | 0.01 | 0.02 | 0.12 | 0.45 | 1.10 |

It will be appreciated from Tables 9 and 10 that the base oil for a lubricating oil should have a high-temperature (100° C.) viscosity of at least 9 $mm^2/s$ and a low-temperature (−40° C.) viscosity of $6\times10^4$ mPa.s or below (compositions b and c). It is also clear from Table 8 that the compositions e and f show limited ingresses of Fe but have such high low-temperature viscosities involving such large losses of torque that they do not aid in smooth starting of the engine and therefore are of no practical use.

As described hereinbefore, the wear-resistant, synthetic lubricating oil compositions of the present invention have good high-temperature stability and low-temperature fluidity. They therefore need no addition of viscosity index improver and undergo little decrease in viscosity after service for long periods. Another advantage is very great wear resistance, or durability against shear stresses. The compositions of the invention are particularly suited as lubricating oils for superchargers of automobiles.

What is claimed is:

1. A wear-resistant, synthetic lubricating oil composition for automobiles comprising as a base oil a synthetic oil mixture consisting of (A) a diester of an aliphatic dibasic acid having 4 to 14 carbon atoms in the molecule and an alcohol having 4 to 14 carbon atoms or a mixture of several such diesters and having a viscosity at 100° C. of 2 to 7 centistokes (B) a polyoxyalkylene glycol whose alkylene group contains 2 to 5 carbon atoms or a mixture of several such glycols and having a viscosity at 100° C. of at least 20 centistokes, said base oil exhibiting viscosity values of 9 centistokes or above at 100° C. and $6\times10^4$ centipoise or below at −40° C.

2. A composition according to claim 1 wherein the viscosity of the base oil at 100° C. ranges from 10 to 17 centistokes.

3. A composition according to claim 1 wherein the alcohol is an aliphatic monohydric alcohol.

4. A composition according to claim 3 wherein the aliphtic dibasic acid contains 6 to 12 carbon atoms in the molecule and the aliphatic monohydric alcohol contains 6 to 10 carbon atoms.

5. A composition according to claim 1 wherein the alcohol is an alicyclic monohydric alcohol.

6. A composition according to claim 5 wherein the alicyclic monohydric alcohol is cyclohexanol or methylcyclohexanol.

7. A composition according to claim 1 wherein the diester is diisodecyl adipate and the polyoxyalkylene glycol is polypropylene glycol.

8. A composition according to claim 1 wherein the diester has a viscosity of at least 2.2 centistokes at 100° C. and the polyoxyalkylene glycol has a viscosity of at least 50 centistokes at the same temperature.

9. A composition according to any of claim 1 through 8 wherein the wear-resistant, synthetic lubricating oil composition is a lubricating oil composition for superchargers of automobiles.

10. A wear-resistant, synthetic lubricating oil composition for automobiles comprising as a base oil a synthetic oil mixture consisting of 80 to 40% by weight of diisodecyl adipate and 20 to 60% by weight of polypropylene glycol having a viscosity at 100° C. of at least 20 centistokes, said base oil having viscosity values of 9 centistokes or above at 100° C. and $6\times10^4$ centipoise or below at −40° C., and at least an extreme pressure agent as additive.

11. A composition according to claim 10 wherein the viscosity at 100° C. of the polypropylene glycol is 30 centistokes or above and the viscosity at 100° C. of the base oil ranges from 10 to 17 centistokes.

12. A composition according to claim 11 wherein the viscosity at −40° C. of the base oil is $4.5\times10^4$ centipoise or below.

13. A composition according to claim 12 wherein the base oil consists of 65% by weight of diisodecyl adipate and 35% by weight of polypropylene glycol having a viscosity at 100° C. of 89 centistokes.

14. A composition according to claim 10 which further comprises as additives one or several or all of antioxidant, metal deactivator, rust preventive, defoaming, and oiliness agents, the total amount of the additives being about 5 to 10% by weight on the basis of the total weight of the lubricating oil.

15. A composition according to any of claim 10 through 14 wherein the wear-resistant, synthetic lubricating oil is a lubricating oil for superchargers of automobiles.

* * * * *